US011535505B2

(12) United States Patent
Pepini

(10) Patent No.: US 11,535,505 B2
(45) Date of Patent: Dec. 27, 2022

(54) FLUID DISPENSER

(71) Applicant: BEEXLAB S.R.L., Corciano (IT)

(72) Inventor: Diego Pepini, Passignano sul Trasimeno (IT)

(73) Assignee: BEEXLAB S.R.L., Perugia (IT)

( * ) Notice: Subject to any disclaimer, the term of this patent is extended or adjusted under 35 U.S.C. 154(b) by 0 days.

(21) Appl. No.: 16/962,894

(22) PCT Filed: Feb. 1, 2019

(86) PCT No.: PCT/IT2019/050026
§ 371 (c)(1),
(2) Date: Jul. 17, 2020

(87) PCT Pub. No.: WO2019/150409
PCT Pub. Date: Aug. 8, 2019

(65) Prior Publication Data

US 2021/0047167 A1 Feb. 18, 2021

(30) Foreign Application Priority Data

Feb. 5, 2018 (IT) ..... 102018000002421

(51) Int. Cl.
*B67D 1/04* (2006.01)

(52) U.S. Cl.
CPC ..... *B67D 1/0462* (2013.01)

(58) Field of Classification Search
CPC .. B67D 1/0462; B67D 1/0412; B67D 1/0418; B67D 1/0425; B67D 1/0431; B67D 1/06
(Continued)

(56) References Cited

U.S. PATENT DOCUMENTS 4,909,289 A * 3/1990 Hagan ..... B67D 1/0832 137/312
5,251,787 A * 10/1993 Simson ..... B67D 1/0462 222/105

(Continued)

FOREIGN PATENT DOCUMENTS

CN 101970311 A 2/2011
CN 106698306 A 5/2017

(Continued)

OTHER PUBLICATIONS

International Search Report, issued in PCT/IT2019/050026, dated Apr. 4, 2019.

(Continued)

*Primary Examiner* — Jeremy Carroll

(57) ABSTRACT

A fluid dispenser includes a containing case having an inner containment cavity for containing a first fluid to be dispensed, which is delimited by at least one pair of walls which have a membrane-like structure, at least one first wall of which is placed in contact with the fluid to be dispensed, a second wall of said pair at least partly surrounding the first wall. The dispenser further includes a closable hollow space, positioned between the first wall and the second wall; and a second fluid which, introduced in the hollow space and interacting with the first wall, imparts to the fluid to be dispensed a movement towards an outlet of the case and a simultaneous action at least of expelling to the outside of the case the gases present in the containment cavity.

17 Claims, 4 Drawing Sheets

(58) Field of Classification Search
USPC ..... 222/94–96, 105, 399, 400.7
See application file for complete search history.

(56) References Cited

U.S. PATENT DOCUMENTS

| | | | | |
|---|---|---|---|---|
| 6,375,048 | B1 | 4/2002 | Van Der Meer et al. | |
| 7,604,147 | B2 * | 10/2009 | Anderson | B67D 1/0462 222/105 |
| 7,896,199 | B2 * | 3/2011 | Kaczmarek | B65D 75/5877 222/94 |
| 8,763,857 | B2 * | 7/2014 | Middleton | B67D 1/0891 222/95 |
| 10,640,356 | B2 * | 5/2020 | Witte | B65B 3/02 |
| 2006/0138177 | A1 | 6/2006 | Wauters et al. | |
| 2009/0020176 | A1 * | 1/2009 | Hasegawa | B67D 7/0261 137/614.05 |
| 2009/0057347 | A1 * | 3/2009 | Leys | B67D 1/0462 222/386.5 |
| 2010/0252584 | A1 * | 10/2010 | Celli | B67D 1/1405 222/400.7 |
| 2012/0132607 | A1 * | 5/2012 | Landman | B65D 1/023 215/12.1 |
| 2021/0047167 | A1 * | 2/2021 | Pepini | B67D 1/06 |

FOREIGN PATENT DOCUMENTS

| | | | |
|---|---|---|---|
| EA | 200000283 | A1 | 12/2000 |
| EP | 2 336 077 | A1 | 6/2011 |
| WO | WO 91/12196 | A1 | 8/1991 |
| WO | WO 01/92145 | A | 12/2001 |
| WO | WO 2015/040146 | A1 | 3/2015 |
| WO | WO 2016/131113 | A2 | 8/2016 |

OTHER PUBLICATIONS

Written Opinion of the International Searching Authority, issued in PCT/IT2019/050026, dated Apr. 4, 2019.

Chinese Office Action, dated Jun. 15, 2021, issued in application No. 201980011070.8.

Search Report, issued in Singapore Application No. 11202006926T, dated Jan. 5, 2022.

Written Opinion, issued in Singapore Application No. 11202006926T, dated Jan. 7, 2022.

Invitation to Respond to Written Opinion, issued in Singapore Application No. 11202006926T, dated Jan. 11, 2022.

* cited by examiner

PRIOR ART

FIG.9
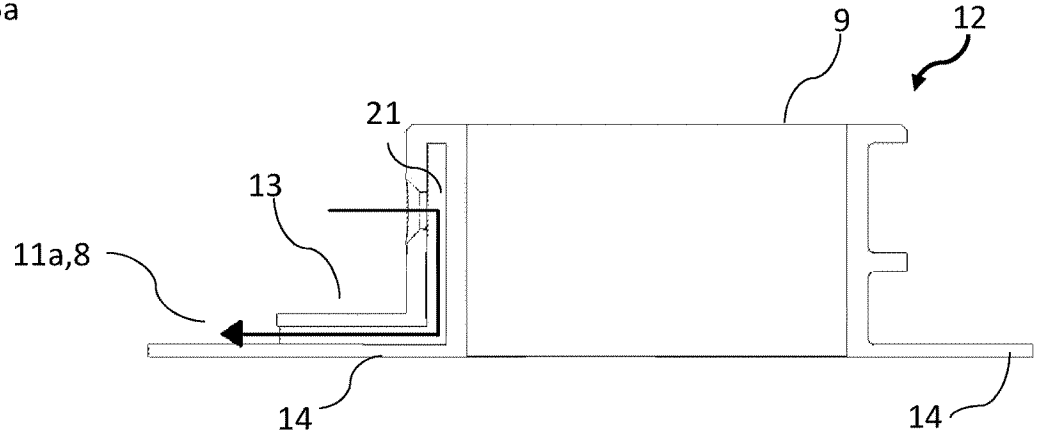
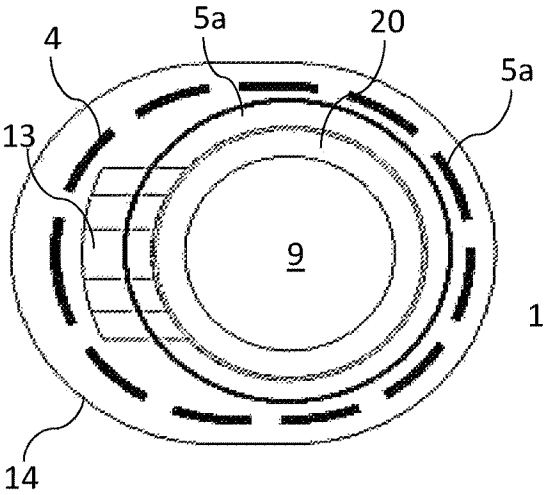
FIG.7

FLUID DISPENSER

TECHNICAL FIELD

This invention relates to a fluid dispenser, specifically a dispenser for liquid foods, such as wine, oil, beer, cocktails and the like.

BACKGROUND ART

Some liquid foods, and particularly wine, once the relative container has first been opened, after contact with air tend to quite rapidly oxidise and change, which significantly deteriorates them and their original organoleptic properties.

For example, wine in a bottle, once opened for the first time degrades by oxidising in around 3 to 5 days.

Wine in a bottle which is subsequently stoppered again including use of a vacuum, has a perishability period of around one week.

If the bottle is stoppered again following the introduction of an inert gas (e.g.: argon), the wine contained in it retains its properties for 3 to 4 weeks; however, that period is reduced faster the higher the number of times the bottle is re-opened and further amounts of wine are taken out.

That state of affairs causes quite considerable problems, in both domestic and professional settings. In fact, in a domestic setting, consumers often open a bottle of wine—which may be of very high quality—and having only consumed one or two glasses of it, must throw away the remaining contents of the bottle after just a few days, because oxidation from contact with the air has changed it.

There are many negative consequences from that behaviour, particularly the obvious waste of material and economic resources, as well as environmental harm. Similar problems arise at a professional level, for example, in catering establishments which serve wine by the glass and in which, in order to avoid throwing away wine which can no longer be served due to degrading, the business must equip itself with complex and expensive machinery able to systematically replace the air that has entered the bottle, after each opening, until all of the contents have been consumed.

A prior art technology, called "bag in box" sees the wine contained and preserved in a bag which can be repeatedly stoppered, which is provided with thin but strong composite walls, formed by several layers of suitable film material which are laminated and if necessary metallised. A box-shaped body contains the bag, supporting it in a vertical position to allow the contents to be emptied from it under the action of gravity and through a special tap which is located in the lower part of the box-shaped body.

A further prior art technology is described in document U.S. Pat. No. 8,763,857. According to that document the air, having come into a bag containing the wine, is expelled by mechanical compression of the bag performed by means of a complex articulated rod mechanism operating under the action of a spring and which is fitted to a related dispenser.

A further prior art solution in the sector is a dispenser which evacuates the air in contact with the wine by means of a device integrated in the dispenser itself and equipped with a vacuum pump which, operating in a suitable hydraulic circuit, extracts the air using the known Venturi tube operating principle.

DISCLOSURE OF THE INVENTION

The aim of this invention is to eliminate the disadvantages of the prior art by devising a dispenser which combines one of the highest levels of efficiency in terms of preservation of the integrity of the organoleptic properties of the fluid contained with a simpler, less expensive and more reliable construction.

Accordingly, the invention achieves those aims with a dispenser as defined in the following claims.

BRIEF DESCRIPTION OF DRAWINGS

The features and further advantages of the invention will become apparent below with reference to an example embodiment of the invention described with reference to the accompanying drawings in which:

FIG. 7 is a top plan view of the detail of FIG. 6;

FIG. 9 is a cross-section of the detail of FIG. 7 explaining a functional aspect of it.

DETAILED DESCRIPTION OF PREFERRED EMBODIMENT OF THE INVENTION

Figure 1:
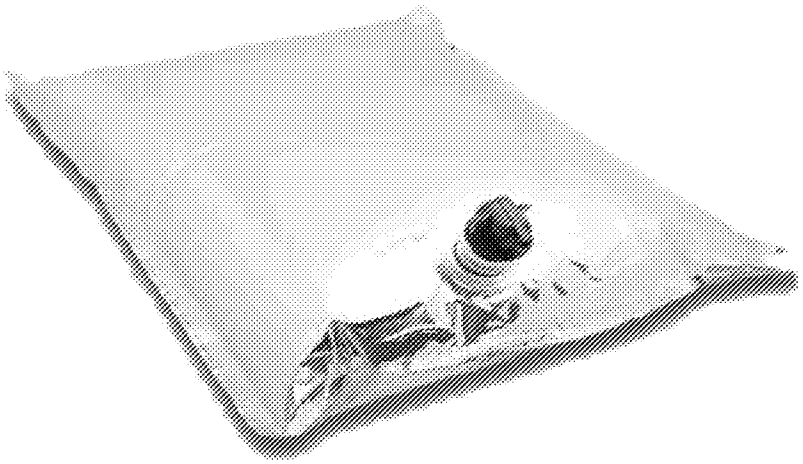
FIG. 1 is a perspective view of a prior art containing bag.
Figure 2:
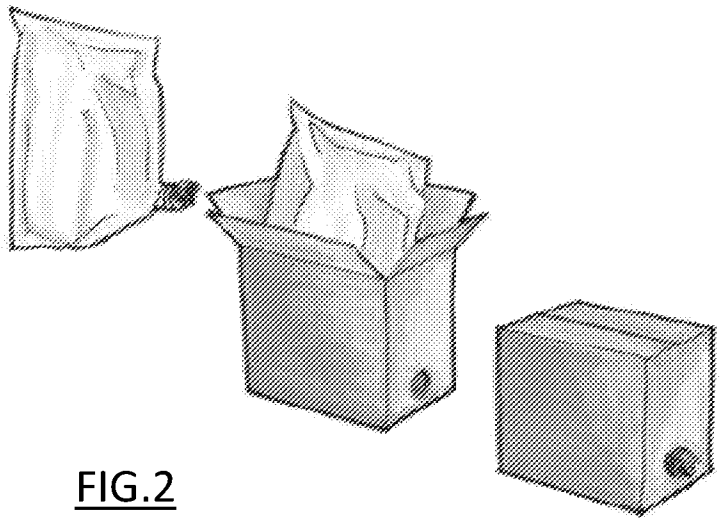
FIG. 2 is a schematic view explaining a known method of use of the bag of FIG. 1.

With reference to the figures of the accompanying drawings, FIG. 1 shows a prior art case for containing liquid foods, which comprises a containing bag intended to operate in combination with a box-shaped body, being placed and contained in the latter, as shown in FIG. 2.

The bag—which is equipped with a lateral surface, defined by several layers of thin, membrane-structure material having high strength and micrometric thickness which are superposed and monolithically welded to each other—substantially defines a containing case suitable for supplying, by falling, that is to say under the effect of gravity, a fluid to be dispensed through a suitable tap which can be switched between two states, respectively open and closed, which is located in the lower part of the box-shaped body.

Figure 4:
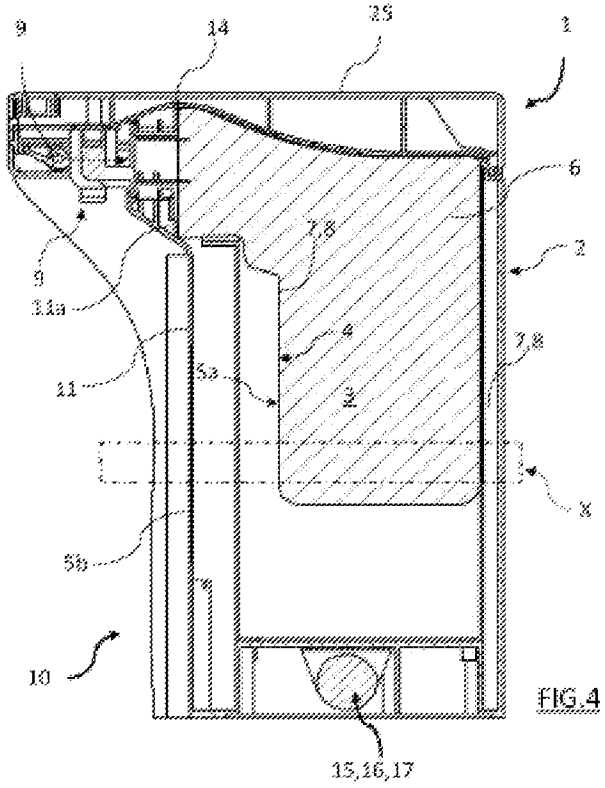
FIG. 4 is a cross-section of another embodiment of the invention.
Figure 3:
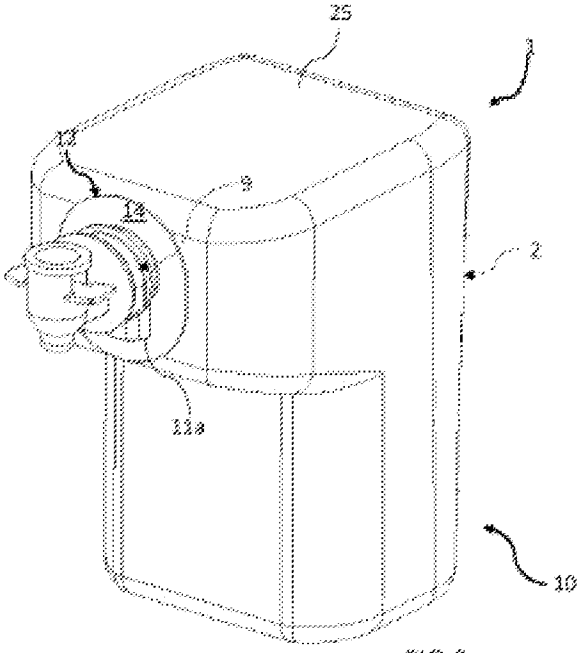
FIG. 3 is a perspective assembly view of the invention shown with some parts cut away to better illustrate others.

FIGS. 3 and 4 respectively show two examples—by way of example only and without limiting the scope of the invention—of a fluid dispenser 1 according to the invention and basically comprising a containing case labelled 2 as a whole, which has an inner containment cavity 3 for a first fluid 6 to be dispensed, said first fluid 6 being in particular, preferably, a liquid food, selected for example from the families of wines, beers, oils and the like.

The containment cavity 3 is delimited by a first enclosing wall 4 which: is substantially bag-shaped; is placed in direct contact with the fluid 6 to be dispensed; and is provided with its own membrane-like structure, made in a multilayer form and with micrometric thickness.

A second wall 5*a* externally covers, by at least partly surrounding, the first wall 4 which contains the fluid 6 and, in combination with the latter, delimits a closed hollow space 7 interposed between the two walls 4, 5*a*. A second fluid 8 is introduced into the hollow space in such a way that it is forced to interact with the first wall 4, on the outer side of the containment cavity 3, compressing it against the fluid 6 behind it.

With the open state of a supplying outlet 9 of a tap located at the top of the case 2 and communicating with the containment cavity 3, under the thrust applied by the second fluid 8 against the wall 4, the fluid 6 to be dispensed is subjected to a movement towards the outlet 9 which causes a primary expulsion action towards the outside of the case 2 of the gases which are present in the containment cavity 3.

When that thrust is further continued—beyond what is necessary for completely expelling the gases—the second fluid 8 causes the subsequent supplying of the fluid 6 forcedly and, as already indicated, from the top zone of the case 2 as shown in FIGS. 3 and 4.

Figure 5:
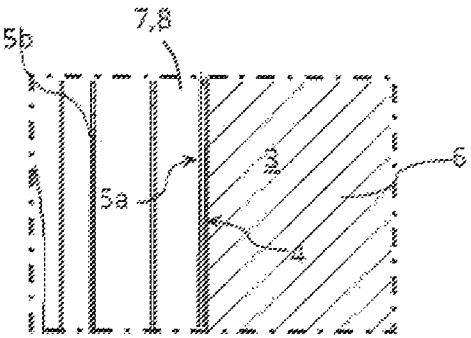
FIG. 5 is a greatly enlarged detail view of a detail whose line "X" is indicated in FIG. 4.

FIGS. 3 and 5 show, in particular, that preferably the hollow space 7 is made between two walls 4, 5*a* which both have micrometric thicknesses and a membrane-like structure. In this context, the walls 4, 5*a* may either have stiffnesses which are similar to each other, or different stiffnesses. In the latter case it is preferable that the greater stiffness is offered by the outermost wall 5*a*, in such a way as to give the containing case 2 an anisotropic behaviour (and if necessary having self-supporting properties) so as to accentuate the effectiveness of the thrust applied by the wall 4 against the fluid 6 to be dispensed, behind and contained in the containment cavity 3.

FIGS. 4 and 5 also show how—in one possible variant of the invention—the hollow space 7 could even be a physical space simply geometrically interposed between the first wall 4 and a second wall 5*b*, which is stiffer and thicker, identifiable as a perimeter wall of a hollow containing body 10 with relative lid 25, which is part of the containing case 2 and which houses inside it, surrounding it and if necessary in a sealed way, a bag defined by the first wall 4 and by the relative inner cavity 3 intended to receive the first fluid 6 to be dispensed.

Figure 6:
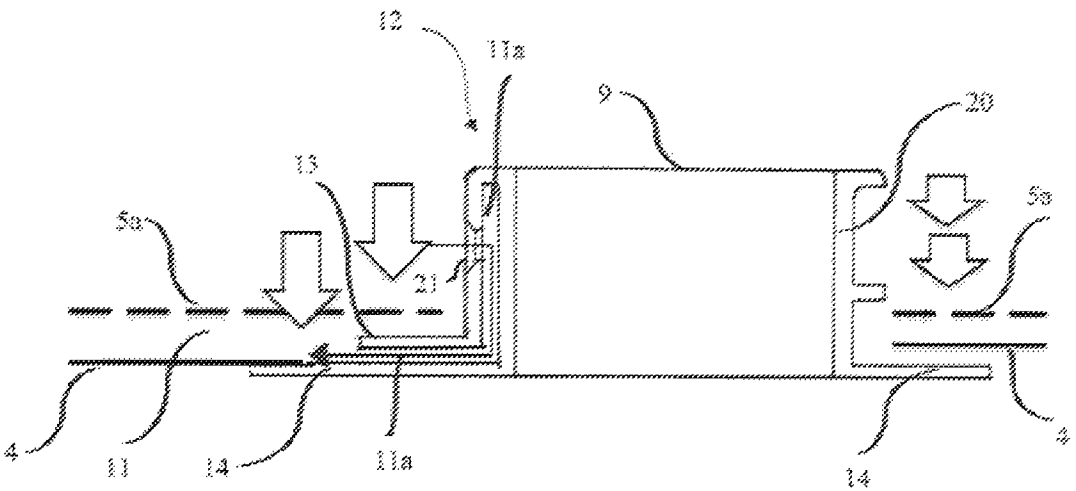
FIG. 6 is a partial cross-section of a detail of the invention.
Figure 8:
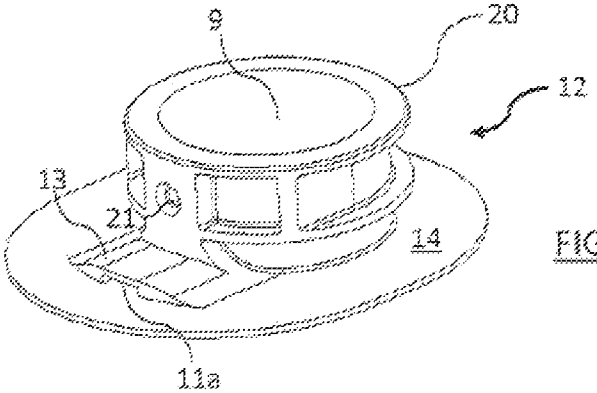
FIG. 8 is a perspective view of a component intended to be fitted to a dispenser according to the invention.

FIGS. 6, 7 and 8 show that the dispenser 1 also comprises a flange 12 which is interconnected with a pair of walls 4 and 5*a* which both have a membrane-like structure and which are superposed on each other (FIG. 6, on the right.

The flange 12, as is clearly shown in FIG. 8, has a flat plate 14 shaped like an annulus, which supports cantilever-style a tubular collar 20, which at its end distal from the plate 14 terminates with the supplying outlet 9.

At a locally thickened zone of its lateral wall, the collar 20 is provided with a basically prismatic projection 13, having smoothed edges, which projects radially from the collar 20 and which projects away from it, partly covering a corresponding underlying local surface of the plate 14.

The projection 13 has, facing the plate 14, a groove with substantially prismatic shape.

Therefore, extending between the projection 13 and the plate 14, at the groove and along the thickened part of the lateral wall of the collar 20, there is a stretch 11*a* of duct which at one end communicates, inside the collar 20, with a hole 21 facing the outside of the case 2 and which at the opposite end abuts a further duct 11, finally arriving in communication with the hollow space 7.

FIGS. 6 and 7 show that the operative interconnection between the projection 13 (which communicates with the environment outside the containing case 2) and the hollow space 7 (however it is made, and placed adjacent to the first wall 4) is obtained by means of a local and special connection between the membrane-like walls 4 and 5*a* and the projection 13.

In fact, unlike what is visible on the right-hand side in FIG. 6—where the projection 13 is not present and the first membrane-like wall 4 and the second membrane-like wall 5*a* are perfectly superposed on each other, welded together and in turn monolithically welded to the underlying annular plate 14—on the left-hand side of said FIG. 6, that is to say, at the location relating to the presence of the projection 13, only the first wall 4 is welded to the plate 14, whilst the second wall 5*a*, locally detached from the first wall 4, is welded directly to the projection 13 there.

In conclusion, if the second flow 8 is gaseous and is the external air, then by positioning on the duct 11 suitable pressing means 15—schematically illustrated in the lower part of the dispensing body 10 in FIG. 4—it is possible to pressurise the hollow space 7, which is suitably closed, in such a way as to completely evacuate through the outlet 9 the air contained in the containment cavity 3 for the first fluid 6 to be dispensed, and it is also possible to supply the first fluid 6 to be dispensed.

It is clear that the positioning of the pressing means 15, which in the example in FIG. 4 are integrated in the structure of the dispenser 1, is particularly useful and advantageous in a portable construction solution of the dispenser 1. However, that should not be considered limiting, since, for example the pressing means 15 could even be positioned outside the case 2 and if necessary could even be independent of it, it being enough for them to be able to send pressurised air, for example through the inlet hole 21 of the duct 11.

Sensor means 16 for detecting a threshold value, which is the limit of the pressure of the second fluid 8 contained in the hollow space 7, relative to which the pressing means 15 must be activated/deactivated, may consist for example of a pressure regulator which, suitably integrated in the pressing means 15, acts as an automatic start/stop switch for the pressing means 15. The invention achieves the proposed aims by allowing the simple, inexpensive and highly effective achievement of a high degree of expulsion of the air from the containment chamber 3: which results in optimum protection against atmospheric oxidation for the fluids contained. That is particularly advantageous for many fluid foods in which oxidation may cause significant modification of the organoleptic properties of the substance, as is the case for example with wine, beer, oil, cocktails, fruit juices and the like.

The invention also brings further advantages, including not requiring any external action in order to completely empty the contents of its containment cavity 3. In fact, unlike what happens in the prior art, for example that shown in FIGS. 1 and 2, the dispenser 1 solution according to this invention and which, as is clearly illustrated in FIGS. 3 and 4, has the supplying tap positioned at the top, allows total emptying of the containment chamber 3 without requiring any tilting of the containing case 2.

The invention advantageously is also suitable for further useful developments, for example the integration of refrigerating means 17 for the fluid 6 to be dispensed, symbolically represented in FIG. 4 which, for example, could also be particularly useful for allowing supplying of the fluid food 6 at optimum preservation and serving temperature conditions, it being known that this is generally required for wines and in particular white wines.

The invention described above is susceptible of evident industrial application. It may also be modified and adapted in several ways without thereby departing from the scope of the following claims.

Moreover, all details of the invention may be substituted by technically equivalent elements.

The invention claimed is:

1. A fluid dispenser comprising:

a containing case having an inner containment cavity for containing a first fluid to be dispensed, the containing case being delimited by at least one pair of walls including at least one flexible first wall of said at least one pair of walls being placed in contact with the first fluid to be dispensed, a flexible second wall of said at least one pair of walls at least partly surrounding said at least one first wall;

a closable hollow space, positioned between said at least one first wall and said second wall;

a second fluid which being introduced into the hollow space and interacting with said first wall imparts to the first fluid to be dispensed a movement towards an outlet of said case and a simultaneous action at least of expelling to the outside of said case the gases present in the containment cavity;

a flange joined to at least one of the walls of said pair of walls; and a first duct for conveying said second fluid into the closable hollow space, said first duct formed in a projection of said flange, wherein said flange has a flat plate shaped like an annulus and a tubular collar, the tubular collar terminating with a supplying outlet at a distal end spaced from the flat plate, wherein said flat plate extends beyond an area covered by said tubular collar, and wherein the projection projects radially away from the collar and axially from a surface of the flat plate.

2. The dispenser according to claim 1, wherein at least one part of said second wall is joined to said projection, and at least one detached part of said at least one first wall is connected to said flange.

3. The dispenser according to claim 1, further comprising a pressing device configured to pressurize said second fluid inside said hollow space.

4. The dispenser according to claim 1, wherein said second fluid introduced into the hollow space is a gaseous fluid.

5. The dispenser according to claim 1, further comprising a sensor for detecting when a threshold value is reached, said value representing the limit of the pressure of the second fluid contained in the hollow space relative to which said pressing device must be activated/deactivated.

6. The dispenser according to claim 1, further comprising a refrigeration device for said first fluid to be dispensed.

7. The dispenser according to claim 1, wherein said first fluid to be dispensed contains at least one liquid food.

8. The dispenser according to claim 7, wherein said liquid food is selected in the families of wines, oils, beers, cocktails.

9. The dispenser according to claim 1, wherein said first wall is bag-shaped.

10. The dispenser according to claim 1, wherein the first and the second wall have a same stiffness.

11. The dispenser according to claim 1, wherein both walls have thickness of 25 micrometers.

12. The dispenser according to claim 1, wherein extending between said projection and said flat plate, a second duct communicates, inside said collar with a hole facing the outside of the casing and abuts said first duct arriving in communication with said hollow space.

13. The dispenser according to claim 1, wherein said flange is positioned at the top of said dispenser.

14. The dispenser according to claim 1, further comprising a second duct extending in the collar, the second duct having a first end communicating with the first duct and a second end communicating with an outlet formed in the collar.

15. The dispenser according to claim 14, wherein the outlet faces radially outwardly.

16. The dispenser according to claim 1, wherein the projection and the collar extend upwardly from an upper surface of the flat plate.

17. The dispenser according to claim 1, wherein the second wall contacts a top surface of the protection and the at least one first wall contacts an upper surface of the flat plate.

* * * * *